United States Patent [19]

Farley

[11] 3,992,249

[45] Nov. 16, 1976

[54] CONTROL OF PULP-PAPER MILL PITCH DEPOSITS

[75] Inventor: Charles Edward Farley, Stratford, Conn.

[73] Assignee: American Cyanamid Company, Stamford, Conn.

[22] Filed: Dec. 8, 1975

[21] Appl. No.: 638,230

Related U.S. Application Data

[63] Continuation-in-part of Ser. No. 458,952, April 8, 1974, abandoned.

[52] U.S. Cl. ..... 162/72; 162/168 R; 162/168 N; 162/168 NA; 162/169; 162/DIG. 4

[51] Int. Cl.[2] ..... D21C 3/20

[58] Field of Search ..... 162/72, 168, 169, DIG. 4, 162/168 R, 168 NA, 168 N; 260/78.5 R

[56] References Cited

UNITED STATES PATENTS

| | | | |
|---|---|---|---|
| 2,723,195 | 11/1955 | Blake | 162/168 R |
| 3,334,072 | 8/1967 | Sellet | 260/856 |
| 3,393,168 | 7/1968 | Johnson | 162/169 |
| 3,840,489 | 10/1974 | Strazdins | 162/168 R |

*Primary Examiner*—S. Leon Bashore
*Assistant Examiner*—Peter Chin
*Attorney, Agent, or Firm*—C. F. Costello, Jr.

[57] ABSTRACT

The deposition of adhesive pitch particles from aqueous suspension of cellulose fibers is inhibited and, if desired, substantially prevented, from depositing on the surfaces of pulp-making equipment by adding to the suspension an anionic polymer containing at least about 25 mol percent but not more than about 85 mol percent of hydrophobic oleophilic linkages selected from the group comprising styrene, isobutylene, methylstyrene, allyl stearate, octadecyl acrylate, octadecene, dodecene, n-octadecylacrylamide, vinyl stearate and vinyl dodecyl ether and at least about 15 mol percent but not more than about 75 mol percent of hydrophilic acid linkages selected from the group comprising acrylic acid, methacrylic acid, maleic acid, itaconic acid, acrylamidoacetic acid, maleamic acid and styrenesulfonic acid, forming a pitch-polymer complex of said particles and said polymer, and removing said complex with the water used to wash said cellulose fiber suspension thereby separating substantially all of the pitch-polymer complex from said cellulose fiber suspension, wherein the amount of polymer thus added prior to beating being in the range of about 0.5–100 parts by weight of polymer per million parts per weight of the suspension.

7 Claims, No Drawings

CONTROL OF PULP-PAPER MILL PITCH DEPOSITS

CROSS REFERENCE TO RELATED APPLICATIONS

This is a continuation-in-part of application Ser. No. 458,952 filed Apr. 8, 1974, now abandoned.

BACKGROUND OF THE INVENTION

The manufacture of pulp from woody cellulosic materials in the Kraft process commences with the step of liberating the cellulose fibers of the wood from the lignin in which they are encased, and from the pitch which they contain. In the Kraft or other alkaline pulping process, the product of this step is a suspension of cellulose fibers more or less free from lignin in an aqueous suspension of pitch in soap form. The pitch, in hard water areas, is converted to adhesive particles by the action of calcium (and possibly by other polyvalent metal ions) which are normally present in hard water. The particles are anionic (so that they are not self-substantive to the cellulose fibers of the suspension) and are very adhesive (so that in pulp making they adhere tenaciously to metal and hydrophobic surfaces with which they come in contact). Deposition of these adhesive, metal-containing particles is particularly liable to occur in the brown stock washers, the bleaching towers, and the subsequent washers. All these and other metal and hydrophobic surfaces, prior to beating or refining, become fouled more or less rapidly with deposits of these particles, and must be cleaned regularly. The removal of these deposits from pulp-mill equipment is costly and, especially when volatile organic solvents are used, is dangerous.

To a person having skill in the art of making pulp, beating and refining have different meanings. However, for the purposes of this invention, by beating and refining, I mean the mechanical cutting or crushing of the cellulosic fibers. Therefore, reference to one term is meant to apply equally to the other.

The initial deposition of these particles is generally in the form of a rough film, and as deposition continues, thick incrustations form particularly on exposed edges to such an extent as to interfere with the operation of the pulp-mill apparatus. The composition of these particles has not been ascertained, and is complex; for example, they appear to contain pitch in free (i.e., unconverted) form. For convenience, therefore, the material of which these particles is composed is hereinafter termed "adhesive pitch".

FIELD OF THE INVENTION

The present invention relates to a method for inhibiting the deposition of pitch onto the surface of pulpmaking equipment during the manufacture of pulp from wood pulp in an alkaline pulping process. More specifically, the present invention relates to a method for inhibiting the deposition of pitch prior to the beating operation in the manufacture of pulp from wood in the Kraft pulping process.

DESCRIPTION OF THE PRIOR ART

It is known that certain conventional monomeric organic and inorganic dispersing agents are effective for inhibiting the deposition of these particles; see "Pulp and Paper", by James P. Casey (Vol. II, 2nd ed., pp. 1096–7). It is further known that sodium polyacrylate and arylsulfonic acid condensates are useful for the purpose (U.S. Pat. Nos. 3,748,220 and 3,154,466). One disadvantage of these agents is that comparatively large amounts are necessary, so that they become a significant item of cost. A second disadvantage is that certain members of this class tend to form foam, and may require the addition of foam control agents.

Anionic polymers have been used to improve the dry strength of paper. However, because of their low concentrations, they are added subsequent to or during the beating operation. See generally U.S. Pat. No. 3,840,489 issued to E. Strazdins. The anionic polymers are useful in these applications because of their high substantivity to cellulose fibers at low concentrations in the presence of alum or cationic polymers.

The anionic polymers of the present invention associate with the adhesive pitch particles to form a pitch-polymer complex. The predominant proportion of this pitch-polymer complex is then removed from the fibrous suspension with the recycled wash water prior to the beating operation.

It should be noted that the invention is independent of the fibrous suspension used. For this reason, the invention could have other applications where there is a need to inhibit or prevent the conversion of pitch in soap form to an adhesive pitch particle, e.g., in water softening or in detergent additives. The invention could also be used in non-alkaline pulping processes to inhibit or prevent the deposition of adhesive particles after the pitch is separated from the cellulose. For example, in a sulfite pulping process, the resins in the cellulose are saponified during and/or after the bleaching operation. Therefore, the polymers of this invention could be used after the bleaching operation.

SUMMARY OF THE INVENTION

The discovery has now been made that the deposition of adhesive pitch particles on the surfaces of pulp-mill equipment is inhibited and, if desired, substantially completely prevented by the addition of certain anionic vinyl polymers carrying hydrophobic-oleophilic and hydrophilic substituents, as more particularly herein described, when added prior to the beating operation in the range of about 0.5 part to 100 parts by weight of the polymer per million parts by weight of the fibrous suspension. This amount is so small as not to affect the properties of the pulp to a discernible extent, and adds no more than a very small element of cost to the pulp-making operation, while greatly decreasing the cost of removal of the deposited particles.

The polymer is added at any place prior to the beating or refining operation. That is, at any place upstream therefrom. In practice I prefer to add the polymer as a solution to the first washer which the pulp encounters after leaving the digesters (the "brown stock" washers). The first washer is preferred because in the Kraft process it is the first place that the pitch would come in contact with fresh water containing calcium, thus converting it from a soap in suspension to an adhesive pitch particle. Adding the polymer at this place inhibits or prevents deposition of the adhesive pitch particles on the surfaces of the washer and on surfaces downstream therefrom. If preferred, however, the polymer may be added as a solution to the washers which follow the bleaching towers, to pulp dilution waters, or to the pulp slurry prior to encountering the first washer.

Adding the polymer at any of these places results in a predominant proportion of the pitch-polymer complex being removed with the recycled wash water. The recycled wash water is then put through the recovery operation where the pitch-polymer complex will be recovered with the black liquor soap or burned with the black liquor, depending on the method of recovery.

Any pitch-polymer complex remaining in the fibrous suspension is carried as a foreign material. If the Kraft paper is unbleached, the pitch-polymer complex will be substantially removed at the Fourdrinier wire. If bleached, the pitch-polymer complex will be substantially removed during the first bleaching stage, with the addition of the bleaching chemical, e.g., chlorine or chlorine dioxide.

The mechanism, chemical or physical, by which the polymer inhibits or prevents deposition of the pitch has not been ascertained, and Applicant does not wish to be limited by any theory.

As an aid to understanding the invention, however, our evidence indicates that the polymer macromolecules associate with the adhesive pitch particles and increase their anionicity, thereby rendering the particles more strongly mutually repellent and so less liable to agglomerate.

The polymers employed in the process of the present invention have an affinity and preferably a strong affinity for pitch and for the aforementioned metal-containing adhesive pitch particles, and they are anioic and preferably strongly anionic. Accordingly, they contain at least about 25 mol percent, but not more than about 85 mol percent of linkages which are hydrophobic and oleophilic, and at least about 15 mol percent, but not more than about 75 mol percent, of hydrophilic acid linkages. These polymers represent a known class, and the class as a whole is generally suited for use in the process of the present invention. Oleophilic linkages are those which are derived from monomers which are soluble in oily hydrocarbons, for example, kerosene, and at least 25 mol percent thereof is needed to render the polymer adequately capable of associating with adhesive pitch particles and rendering use of the polymer economic.

Suitable hydrophobic-oleophilic linkages include styrene, isobutylene, methylstyrene, allyl stearate, octadecyl acrylate, octadecene, dodecene, N-octadecylacrylamide, vinyl stearate, and vinyl dodecyl ether.

Suitable hydrophilic anionic linkages include acrylic acid, methacrylic acid, maleic acid, fumaric acid, itaconic acid, acrylamidoacetic acid (made by reaction of acrylamide with chloroacetic acid), and maleamic acid. Sulfo acids may be present to provide enhanced anionicity. All the foregoing acids provide hydrophilic anionic linkages, which may be present in acid or ionizable salt form.

If desired, the polymers may contain linkages which are neither pronouncedly anionic nor hydrophobic-oleophilic, and which, therefore, may be regarded as inert or spacing linkages. Such linkages include methyl acrylate, acrylonitrile, dimethyl maleate, methyl methacrylate, etc.

Suitable polymers can be prepared from the monomers named above (and mixtures thereof) by conventional emulsion polymerization procedures, i.e., by emulsification in the absence of oxygen in the presence of a suitable initiator, for example, benzoyl peroxide, or by polymerization in toluene or other inert mutual solvent in the presence of azobisisobutyronitrile.

Since the polymer produces a beneficial action when present in the aqueous phase of the fibrous suspension prior to beating or refining in the range of 0.5 to 100 parts per million, the polymer need not be water-soluble in the ordinary sense of the word, and, in fact, may be seemingly water-insoluble, as polymers which contain 15 mol percent of hydrophilic substituents are soluble in water at least to this extent and this is sufficient to permit them to be used satisfactorily in the process of the present invention. However, the polymer may not be water soluble in larger quantities.

Pulp manufacturers, for convenience, generally prefer to meter polymer additives in aqueous solution form (at about 10% solids). Hence, I prefer to use polymers of the class described which are soluble or self-dispersible in water to the extent of at least 10% either in free acid or in sodium or other salt form.

The effective amount of polymer to be added in any instance depends on a number of variables including the average diameter of the suspended adhesive particles, the intrinsic anionicity of these particles and their content of unsaponified fatty acid material, the pH of the suspension, and the cellulose and lignin content of the pulp. The effective amount, however, can readily be found by trial within the range mentioned.

The polymer may be added if desired in dry particulate form as the free acid or as the dry alkali metal or ammonium soap, but is more conveniently added as a dilute aqueous solution of a soluble salt form.

The polymers which are preferred for use in the present invention contain styrene as the sole hydrophobic-oleophilic component because styrene is very hydrophobic and has a strong affinity for pitch, and polymerizes readily with hydrophilic acidic vinyl compounds exemplified by acrylic acid, maleic anhydride, fumaric acid, and styrenesulfonic acid. Styrene generally copolymerizes with these monomers in molar ratio between about 50:50 and 70:30, and so almost automatically provides polymers having the necessary minimum proportion of each component.

The preferred anionic linkages are the maleamic acid and maleic acid linkages. These linkages are derived from maleic anhydride. They are readily formed, are highly anionic, and very effective.

The polymers are soluble at a high alkaline pH, e.g., pH 12. A pH range from about 8 to about 14 is normal as the liberated fibers are initially suspended in the cooking liquor prior to washing. As a result, these polymers are efficient in inhibiting formation of pitch deposits in the Kraft process.

Suitable methods for the manufacture of polymers useful in the present invention are disclosed in U.S. Pat. Nos. 2,286,062; 2,439,227; 2,490,489; 3,297,620; 3,368,987; and 3,436,378; which are incorporated by reference into the present application.

The invention is more particularly described by the examples which follow. These examples constitute preferred embodiments of the invention and are not to be construed as limitations thereon.

DESCRIPTION OF THE PREFERRED EMBODIMENTS

EXAMPLE 1

The following illustrates the comparative effectiveness of certain anionic polymers containing hydrophobic-oleophilic linkages and acidic and non-acidic hydrophilic linkages in inhibiting the deposition of adhesive pitch particles from an aqueous suspension of cellulose fibers having a content thereof.

In each instance a standard pitch-containing laboratory pulp is used, prepared by suspending 12.5 g. of northern kraft pine pulp (thoroughly bleached and washed to remove all pitch therefrom) in 2.4 liters of water at 50° C. in 4-liter polyethylene beaker provided with a stirrer, adding 3 g. (solids basis) of pitch as the potassium soap (prepared by dissolving 3 g. of distilled tall oil in 50 cc. of ethanol containing a slight excess of potassium hydroxide over that required to neutralize the pitch acids).

The desired amount of a deposition-inhibiting polymer is then added.

The pH of the suspension is then adjusted to 9.5 and 1.7 g. of calcium chloride is added as a 10% solution in water to simulate the effect of hard water and convert the pitch soap to adhesive pitch particles after which the pH of the suspension is adjusted to 8.0 with dilute hydrochloric acid and made up to 2.5 liters.

Two bright, smooth stainless steel panels each 3 inches × 4 inches × 1/32 inch are rigidly suspended in the fibrous suspension to simulate the surface of an item of papermaking equipment. The suspension is stirred moderately for 15 minutes, after which the panels are removed, dried and weighed to determine the amount of pitch deposited thereon.

This procedure simulates in standard manner the commercial washing of unbleached kraft pulp with introduction of an anti-deposition polymer into the make-up water of the washer, except that the concentration of pitch is in excess of that which is commercially encountered to permit the efficiency of the anti-depositing agent to be determined more quickly. In commercial washing, the pitch-polymer complex formed would then be removed from the fibrous suspension with the recycled wash water prior to the fibrous suspension going to the beating operation, thereby separating substantially all of the pitch-polymer complex from said cellulose fiber suspension. The recycled wash water is then put through the recovery operation where, depending on the method of recovery, the pitch-polymer complex is burned with the black liquor or recovered with the black liquor soap.

The following polymers are employed.

A. Styrene:maleic acid copolymer (50:50 molar ratio), disodium salt;

B. Styrene:maleamic acid:maleic acid copolymer (50:25:25 molar ratio), trisodium salt;

C. Styrene:acrylonitrile:maleamic acid copolymer (50:10:40 molar ratio), ammonium salt.

Polymer A is made by hydrolyzing a commercial styrene-maleic anhydride copolymer with sodium hydroxide at room temperature.

Polymer B is made by amidating the above starting polymer by dissolving it in the calculated amount of 5% aqueous ammonium hydroxide at room temperature and allowing the solution to stand until reaction of the ammonium hydroxide is substantially complete, followed by addition of the calculated amount of aqueous sodium hydroxide solution to form the sodium salt.

Polymer C is made by amidating a 50:10:40:molar ratio styrene:acrylonitrile:maleic anhydride copolymer and simultaneously forming its ammonium salt by dissolving it in the calculated amount of 5% aqueous ammonium hydroxide at room temperature.

A control run is made without addition of any polymer.

Results are as follows:

| Run No.[1] | Polymer Added | P.p.m.[2] | Mg. Pitch Deposited On Plates | Appearance of Plates |
|---|---|---|---|---|
| Control | None | | 406.0 | Completely, and thickly covered; edges heavily encrusted. |
| 1 | A | 3 | 305 | Discontinuous film; moderately encrusted. |
| 2 | A | 10 | 172.2 | Discontinuous film; slightly encrusted. |
| 3 | A | 25 | 35.0 | Traces of film. |
| 4 | A | 75 | None | Clean. |
| 5 | B | 3 | 284.9 | Discontinuous film; moderately encrusted. |
| 6 | B | 10 | 118.8 | Discontinuous film; no encrustment. |
| 7 | B | 25 | 11.3 | Few "dusty" areas. |
| 8 | B | 75 | None | Clean. |
| 9 | C | 3 | 279.6 | Discontinuous film; moderately encrusted. |
| 10 | C | 10 | 69.0 | Patches of film; no encrustment. |
| 11 | C | 25 | 8.0 | Practically clean. |
| 12 | C | 75 | 2.2 | " |
| 13 | C | 100 | None | Clean |

[1]See text above.

[2]Parts of polymer by weight per million parts by weight of the aqueous phase of the fibrous suspension.

EXAMPLE 2

A mixture of 50 g. of isobutyl vinyl ether, 49 g. of maleic anhydride, 100 g. of toluene and 1 ml. of di-t-butyl hydroperoxide in a flask equipped with stirrer, thermometer, reflux condenser and electric heating mantle is refluxed for 24 hours and the toluene is then stripped off under vacuum. The product is dissolved in dilute potassium hydroxide solution and is an effective pitch control agent.

I claim:

1. A process for inhibiting the deposition of adhesive pitch particles onto the surface of pulp-making equipment, prior to beating, from the water with which a cellulose fiber suspension having a content of said particles is being washed, which comprises, washing said suspension in a pulp washer containing an aqueous solution of an anionic polymer containing at least about 25 mol percent, but not more than about 85 mol percent, of hydrophobic-oleophilic linkages selected from the group comprising styrene, isobutylene, methylstyrene, allyl stearate, octadecyl acrylate, octadecene, dodecene, n-octadecylacrylamide, vinyl stearate and vinyl dodecyl ether and at least about 15 mol percent, but not more than about 75 mol percent, of hydrophilic acid linkages selected from the group comprising acrylic acid, methacrylic acid, maleic acid, itaconic acid, acrylamidoacetic acid, maleamic acid and styrenesulfonic acid, forming a pitch-polymer complex of said particles and said polymer, and removing said complex with the water used to wash said cellulose fiber suspension thereby separating substantially all of the pitch-polymer complex from said cellulose fiber suspension, wherein the amount of said polymer being used is in the range of about 0.5 to 100 parts by weight per million parts by weight of said suspension.

2. A process according to claim 1 wherein the fiber suspension has an alkaline pH.

3. A process according to claim 1 wherein the polymer is a styrene-maleic acid copolymer in molar ratio of about 50:50.

4. A process according to claim 1 wherein the polymer is a styrene:maleamic acid:maleic acid copolymer in a molar ratio of about 50:25:25.

5. A process according to claim 1 wherein the polymer is a styrene:acrylonitrile:maleamic acid copolymer in a molar ratio of about 50:10:40.

6. A process according to claim 1 wherein the polymer is in sodium salt form.

7. A process according to claim 1 wherein the polymer is in the range of about 2.5 to 25 parts by weight per million parts by weight of said suspension.

* * * * *